US006390878B1

(12) United States Patent
Zhou et al.

(10) Patent No.: US 6,390,878 B1
(45) Date of Patent: May 21, 2002

(54) SHAPE MEMORY ALLOY ACTUATORS FOR TOY VEHICLES

(75) Inventors: Li-Min Zhou; Boon-Wai Shiu; Andrew Meng-Cheung Young, all of Kowloon (HK)

(73) Assignee: The Hong Kong Polytechnic University, Hung Hom Kowloon (HK)

( * ) Notice: Subject to any disclaimer, the term of this patent is extended or adjusted under 35 U.S.C. 154(b) by 0 days.

(21) Appl. No.: 09/450,119

(22) Filed: Nov. 26, 1999

(51) Int. Cl.[7] ..... A63H 33/00

(52) U.S. Cl. ..... 446/14; 446/435; 446/486; 446/465

(58) Field of Search ..... 446/14, 470, 465, 446/486, 431, 435; 374/205, 206, 207; 40/442, 411, 421

(56) References Cited

U.S. PATENT DOCUMENTS 1,676,296 A * 7/1928 Spencer ..... 446/14
2,675,543 A * 4/1954 Marchment ..... 40/442
4,244,140 A * 1/1981 Kim ..... 446/14
4,693,693 A * 9/1987 Kennedy et al. ..... 446/6
4,762,511 A * 8/1988 Lee et al. ..... 446/6
5,013,276 A * 5/1991 Garfinkel ..... 446/14
5,022,884 A * 6/1991 Hippely et al. ..... 446/14
5,138,779 A * 8/1992 Earnest ..... 446/14
5,213,538 A * 5/1993 Willett ..... 446/4
5,518,433 A * 5/1996 Sneddon ..... 446/14

* cited by examiner

*Primary Examiner*—Derris H. Banks
*Assistant Examiner*—Faye Francis
(74) *Attorney, Agent, or Firm*—Jacobson Holman, PLLC

(57) ABSTRACT

This invention provides a toy vehicle incorporating actuators made from a shape memory alloy material. These actuators may be in the form of a spring, wire or similar form that has a mechanical response upon the application or removal of heat. In particular, wires may be connected about hinges for doors, hoods, convertible roofs and other such items which, upon the application of heat to the wire of shape memory alloy, causes contraction of the wire and rotation about the hinged joint of the body part. As such shape memory alloy actuators are generally only operably in a single direction, they may be provided in pairs or in opposition to another biasing means to cause the opposed rotation about the joint when desired. The preferred source of heat to the shape memory alloy actuators is through the provision of electrical energy to the wire to create heat through the resistance of the shape memory alloy actuator itself.

6 Claims, 6 Drawing Sheets

SHAPE MEMORY ALLOY ACTUATORS FOR TOY VEHICLES

FIELD OF THE INVENTION

This invention relates to toy vehicles and, in particular, the use of shape memory alloys to activate moving parts of such toy vehicles.

BACKGROUND TO THE INVENTION

There is a popular market for toy vehicles throughout the world. In many instances, the consumer is looking for as much activity and play value in the vehicle as possible together with as much control over the parts of the vehicle.

Although many such vehicles may be motorized, this generally comprises an electric motor powered by batteries to run a drive train and often an electrical wiring loom for lights or similar. However, more subtle movements of components such as the opening of doors, hoods, steering mechanisms and similar items have generally proved too costly or difficult to incorporate individual drive mechanisms for these components. As a result, such items as doors on a miniature replica or similar are likely to be made with simple hinge mechanisms to allow them to be manually opened and closed.

Not only is cost affected in providing drive mechanisms for such components, but the size constraints often preclude the fitment of items to allow such movements. If they can be fitted at all, the toy designer is severely constrained in further aspects of the design to allow incorporation of the additional components.

OBJECT OF THE INVENTION

It is an object of the present invention to provide shape memory alloy actuators for toy vehicles to overcome some of these problems with prior art toy vehicles or at least provide the public with a useful choice.

SUMMARY OF THE INVENTION

Accordingly, in the first aspect, the invention may broadly be said to consist in a toy vehicle comprising:

a main body portion;

at least one component attached to or with said main body portion capable of reciprocating motion between a first position and a second position;

a drive mechanism to activate motion of said movable component including at least one element formed from a shape memory alloy that may drive said motion upon the supply of heat to said shape memory alloy component; and means to heat said shape memory alloy component.

BRIEF DESCRIPTION OF THE DRAWINGS

Further aspects of the invention will now be described with reference to preferred embodiments and drawings in which.

DETAILED DESCRIPTION OF PREFERRED EMBODIMENTS

Figure 1:
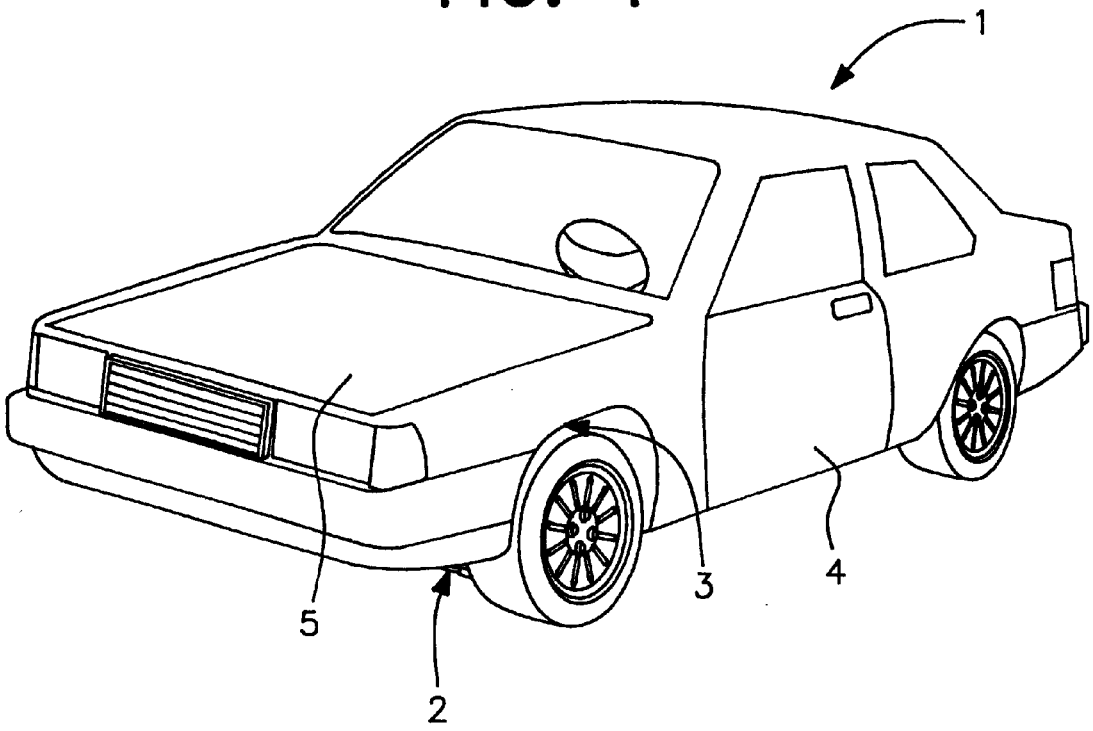
FIG. 1 is a perspective view of a toy vehicle including at least one embodiment of the invention.

This invention relates to the use of shape memory alloy actuators, particularly in a vehicle 1 as shown in FIG. 1. This particular figure shows a diagrammatic vehicle in the form of a car although will be appreciated that the preferred embodiments may be applied to a wide variety of vehicles including but not limited to, cars, motorcycles, bicycles, tricycles, tanks, trains, emergency vehicles, etc. In particular, aspects of the invention may be applied to those vehicles where moving parts are particularly desirable such as toy construction, agricultural and earth-moving vehicles.

In all such vehicles, the provision of small drive units in the form of electric motors and gear boxes for the moving parts is a significant portion of the cost of the vehicle. Additionally, the size of these items can either preclude their inclusion or cause considerable constraints on the design of the vehicle so that they may be incorporated.

This invention seeks to provide alternative activation of a number of these items by the use of shape memory alloys. Shape memory alloys themselves come in a variety of forms although perhaps the most common is a nickel titanium alloy. Such alloys can be manufactured in the form of wires or thin stripes for use directly or for manufacture into springs or similar.

A shape memory alloy as referred to in the description is an item capable of phase transformation in response to thermal changes. The materials undergo a phase transformation in their crystal structure when cooled from the stronger, high temperature form to the weaker, lower temperature form.

These materials are generally easily deformed to a new shape when at the weaker low temperature form. However, upon the application of energy to heat the material, a phase transformation occurs which causes the material to recover its previous shape with considerable force.

The composition of the alloy allows considerable variation in the temperatures at which this transformation takes place. The transformation itself may occur over a range of just a few degrees Celsius and the composition of the alloy allows the start and finish temperatures of the transformation to be controlled within a matter of a few degrees if necessary.

Taking the example of the shape memory alloy formed into a wire, the low temperature form is a weak, easily deformable wire. However, once heated, the wire contracts to its high temperature form and is capable of applying a considerable tensile force in the process. It should be noted that no similar force is generated in the form of compression when moving to the low temperature form and, therefore, the alloys are generally more suitable for a single actuation in a single direction.

To provide more useful actuators for moving parts, such wires may be incorporated in tandem or a single wire may be used in conjunction with a spring or similar means to assist with the motion in the opposed direction.

Although useful in a number of circumstances, such actuators are preferably applied where reciprocating motion over a limited amount of travel is required. Of course, with the use of mechanical linkages, such motion may be transformed into rotational motion of a shaft or similar.

The use of shape memory actuators may remove the need for individual motors. Furthermore, the relatively thin wires can be incorporated in confined spaces in the vehicle to allow considerable flexibility in the design of vehicles.

The source of heat to activate the shape memory alloy may come in any convenient form. A heat sink may be used to retain thermal energy for use when desired and the actuators merely brought into thermal communication with that heat sink as required. Perhaps one of the easier forms of applying heat to or creating heat in such actuators may be in the form of an electrical current. The actuators may be placed in a variety of locations throughout a vehicle and controlled through the controlled connection to a source of electrical current such as batteries or similar. Once a current has passed through the wires, the wire may heat up through the transformation temperature and cause the phase transformation.

Various specific embodiments are further described with reference to the figures. Referring to FIG. 1, the actuators may be applied to the steering mechanism 2, a suspension system 3, doors 4, a vehicle hood 5 or various other parts as described.

Figure 2:
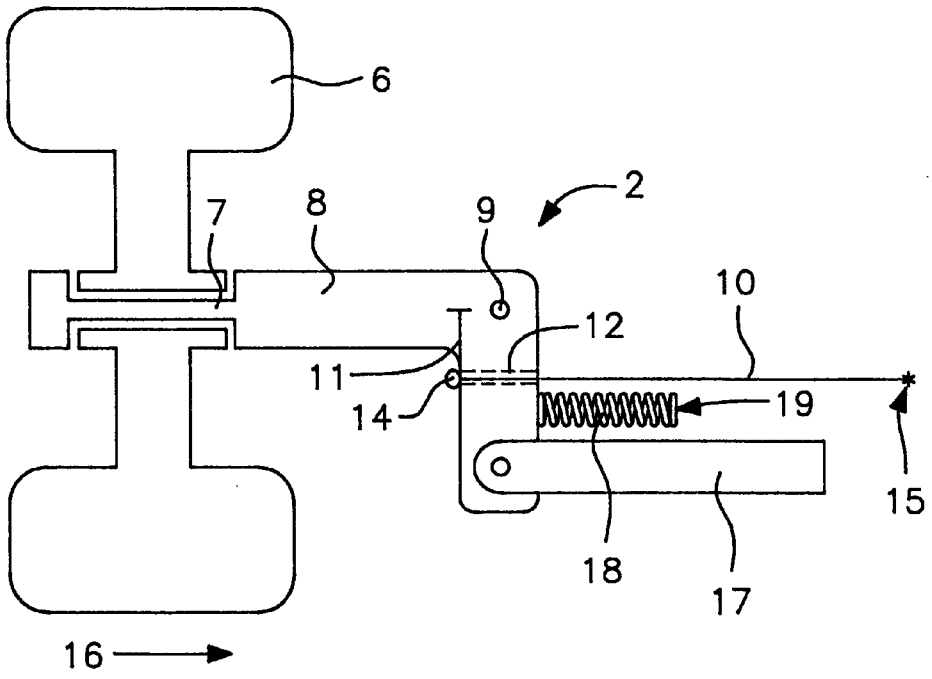
FIG. 2 is a cross sectional elevation of a steering mechanism in accordance with one possible embodiment of the invention.

Turning initially to FIG. 2, a cross sectional plan view is shown through a steering mechanism 2. In this view, a wheel 6 is attached to an axle 7 and a steering arm 8. The steering arm may be pivotally mounted on a mounting 9 such that the wheel 6 is rotatable about the pivotal mounting 9.

An actuating wire 10 may be attached to the steering arm 8 at a distance 11 from the pivotal mounting 9. As shown in this embodiment, the attachment of the wire 10 to the steering arm 8 may simply comprise the passage of the wire 10 through an aperture 12 in the steering arm 8 and a suitable stop 14 applied to the end of the wire 10 to stop the wire 10 being removed from the aperture 12.

A distal end 15 of the wire 10 may be attached to a fixed point on the vehicle 1.

Upon the application of heat to the wire 10, the wire will constrict to its high temperature form. The pull on the wire 10 between the fixed point 15 and the end 14 will create a turning moment in the steering arm 8 about the pivotal mounting 9. As a result, the wheel 6 will turn in the direction indicated by arrow 16.

As may be appreciated, this is a relatively simplistic mechanism. At present, this embodiment only turns a single wheel in a single direction. However, the incorporation of a tie rod 17 between the steering arms 8 of a front or rear pair of wheels will ensure corresponding movement of the associated wheel.

If it is desired to turn the wheel 6 to the opposed direction, a mirror image of this actuator may be applied to the wheel in the front or rear pair connected by the tie rod 17. On that wheel, activation of a similar shape memory wire will cause the opposed wheel to turn in the opposite direction and drive this wheel 6 through the tie rod 17.

In this manner, a relatively simple mechanism has been provided to turn the wheels left or right simply upon the application of heat to each of a pair of shape memory wires.

To complete the embodiments, it may be desirable to include a stabilizing mechanism 18 in the form of a compression spring or similar to return the wheels to the position for direct forward travel. Upon removal of the heat source from either actuator 10, the springs or similar stabilizing mechanisms 18 will dominate and allow the low temperature form of the wires to be easily manipulated into the central position for direct forward travel.

Again, it is intended that the stabilizing mechanism such as the spring 18 can easily be placed between the steering arm 8 and a fixed point 19 on the body of the vehicle.

A yet further range of actuators is shown in FIGS. 3A to 3E, each applied, in this instance, to a body panel of the vehicle such as a door or hood to the intended engine compartment.

Figure 3A:
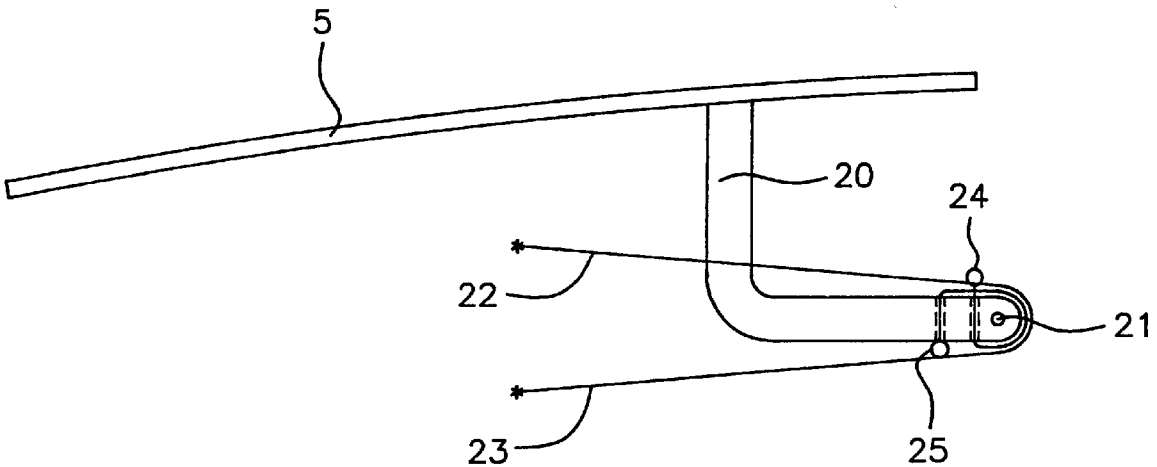
FIGS. 3A to E show various views of an activation system for a hood, door or similar item in accordance with a further embodiment of the invention.

Referring to FIG. 3A, a hood of a vehicle 5 can be seen to be mounted on a support arm 20 which itself is pivotally mounted on a rotational support 21. The hood 5 can rotate about the rotational mounting 21 to assume opened and closed positions.

A first actuation system is shown in FIG. 3A in which a pair of shape memory alloy actuators 22 and 23 are utilized. As can be seen from the diagram, each of these actuators applies a rotational force on the support arm 20 about the rotational mounting 21 and each works in an opposed direction to the other. Upon supplying heat to either of the wires 22 or 23, the reduction in length of the wire will create a pull on the ends 24 and 25 respectively supported in the support arm 20. Alternate activation of the wires can open or close the hood as desired.

This particular system shows the use of two shape memory alloy actuators, one for each of the opened and closed motions of the hood 5. It will be appreciated that it is possible to only use a single actuator operating against an opposed biasing means (not shown) such as a spring or similar. The application of heat to an actuator to, for example, open the hood 5 may do so against the action of a compression spring which will then return the hood to the closed position upon removal of the heat source.

As such an actuation requires the continuous supply of heat to the shape memory alloy actuator to retain the body panel in the opened position, it may be preferred to provide a balanced body panel such as the hood 5 that is capable of rotating to a stable position in both the opened and closed positions and using duplicate actuators as shown in FIG. 3A to reduce continuous energy requirements if it is desired to leave the hood 5 open for sometime.

Figure 3B:
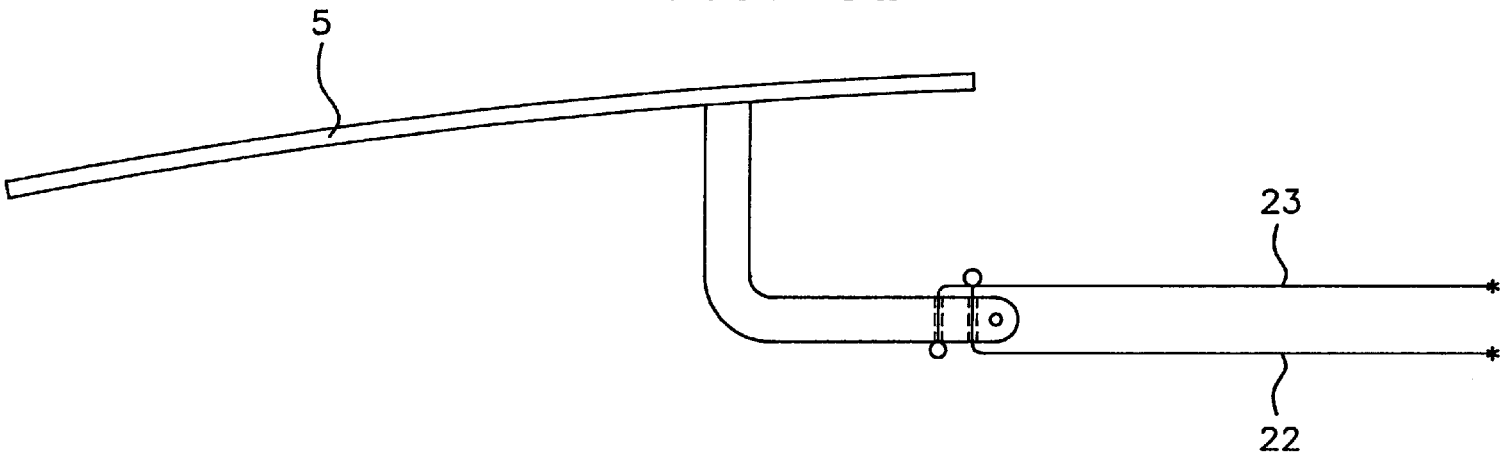

An alternative actuation is shown in FIG. 3B. Again, the general arrangement of the items is similar to the previous embodiment although, in this case, the actuators extend rearwardly of the opening panel rather than enclosing the hinge and actuating from the alternative direction.

It should be noted that in both embodiments, it is intended that the end of the shape memory alloy actuator distal from the hinge is connected to a fixed point on the body of the vehicle such that the reduction in length of the wire will cause the ends 24 and 25 connected to the support member 20 to move and create the rotation.

Figure 3E:
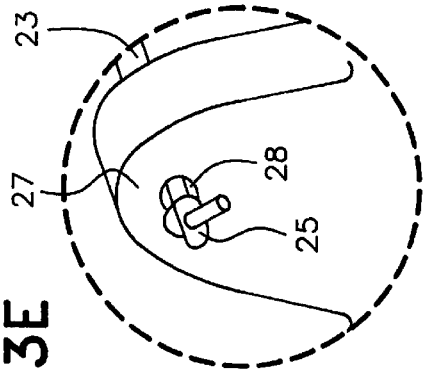
Figure 3C:
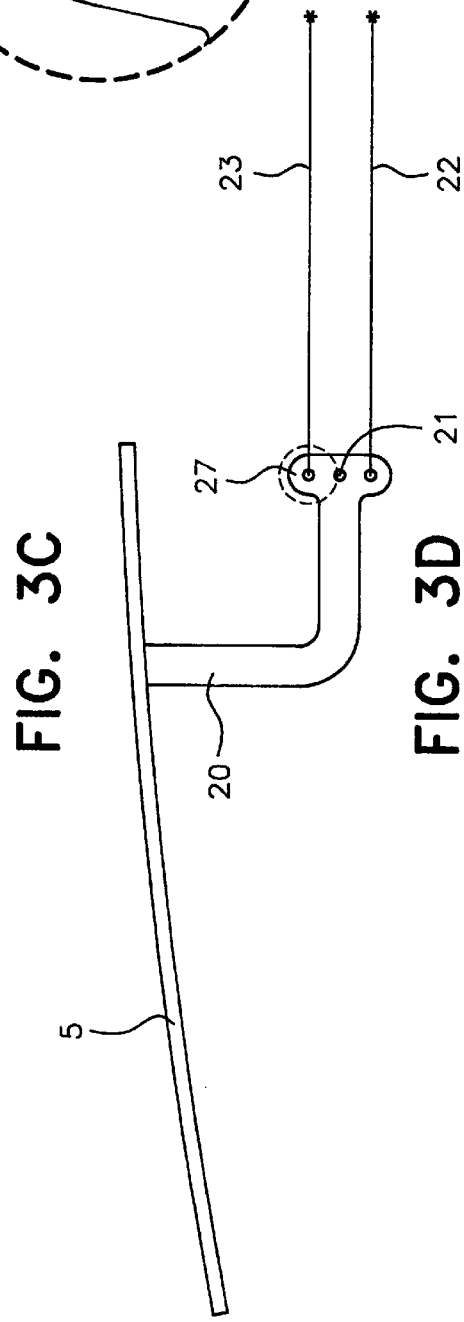
Figure 3D:
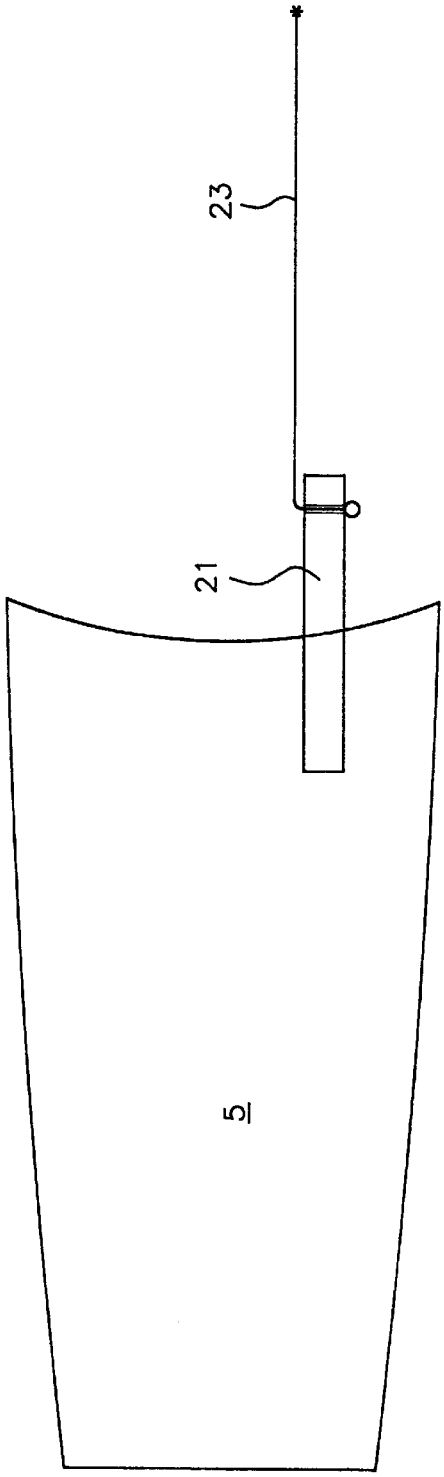

Referring to FIGS. 3C, 3D and 3E, a further embodiment is shown again with reference to a hood 5 of a vehicle.

Again, the general arrangement is very similar with the hood 5 supported on a support arm 20 mounted about a rotational mounting 21. In this case, a T-shaped end piece to the support arm is provided around the rotational mounting 21 with the actuating wires 22 and 23 connected to the T-shaped end piece. This provides the wires with some increased spacing of the line of actuation away from the rotational mounting 21 so as to create a greater turning moment if desired.

FIG. 3E shows a detailed view of the wire 23 and its end piece 25 which may be provided as an enlarged end or similar to retain the wire 23 in communication with the T-shape end piece 27 having passed through an aperture 28. Numerous other forms of connection could be used.

Referring to FIG. 3D, a plan view of the arrangement is shown.

Figure 4:
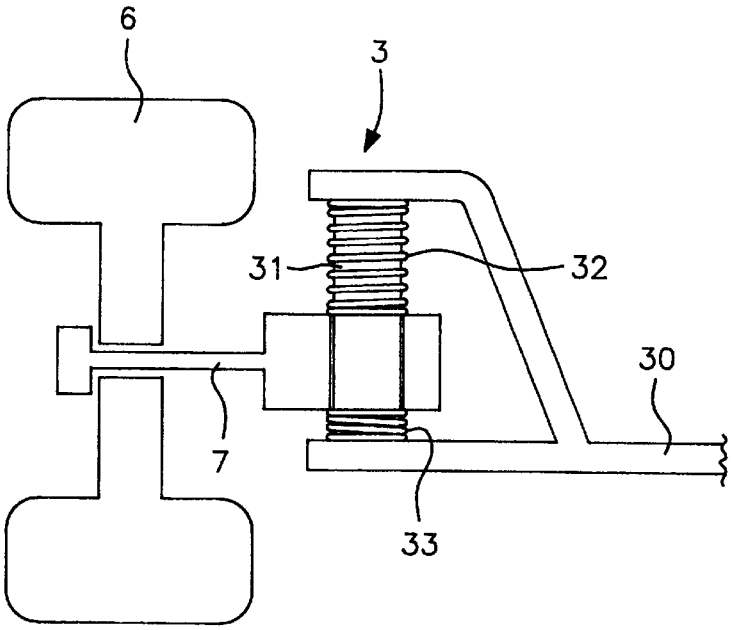
FIG. 4 shows a cross sectional elevation through a suspension mechanism in accordance with a yet further embodiment of the invention.

A yet further embodiment of the invention is shown in FIG. 4. In this instance, the embodiment comprises a suspension system 3 for a vehicle.

As shown, a wheel 6 is rotationally mounted on an axle 7 which itself is connected to a suspension strut 31. It is intended that the connection between the axle 7 and the strut 31 allows movement of the axle 7 along the strut 31 relative to the support frame 30 of the vehicle.

Shape memory alloy members 32 and 33 are provided, in this preferred embodiment, in the form of springs. These are on opposed sides of the axle 7 and its connection to the support strut 31.

Like the wires explained in the previous embodiments, a spring from shape memory alloy will also contract upon the application of heat or otherwise transform into its high temperature form. This allow movement of the springs 32 and 33 upon the application of heat to either spring. As with the previous embodiments, the application of heat may also be in the form of applying a current through the wire to create an increase in temperature through the resistance of the wire or spring.

By providing the actuating elements on either side of the axle 7, the position of the axle 7 on the support strut 31 can be manipulated by the application of heat to one or other of the shape memory alloy elements. This allows the vehicle to be raised or lower as desired or through the sequencing of heat to each spring, the vehicle may be made to jump or dance.

As with the previous embodiments, a single shape memory alloy actuator may be paired with a normal compression or tension spring or other biasing means to oppose the actuation of the shape memory alloy element.

Although this embodiment has been described with reference to the shape memory alloy elements in the form of springs, alternative elements such as a direct wire from the axle 7 over the top of the support strut 31 to a fixed point on the vehicle can cause a similar motion of the axle 7 along the support strut 31. The advantage of springs is that they may continue to provide some suspension and oscillating motion after a single actuation.

Figure 5:
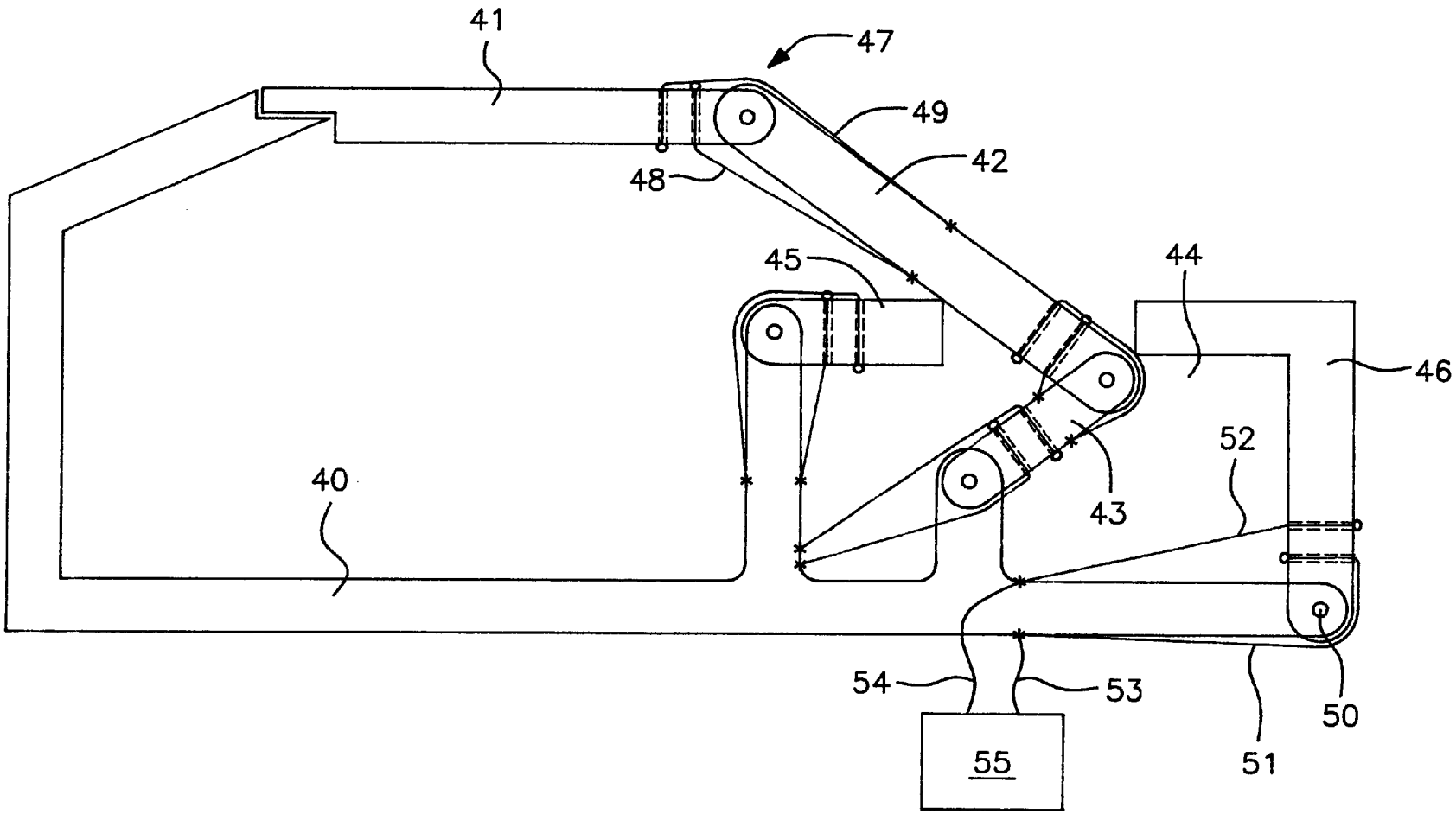
FIG. 5 shows cross sectional elevation of a top for a toy convertible vehicle in accordance with a yet further embodiment of the invention.

A yet further embodiment of this invention is shown in FIG. 5.

In this embodiment, shape memory alloy actuators are used to actuate the supports for a roof structure of a convertible toy vehicle. As with many other items on the toy vehicle, automation or control over the sequenced movements to extend or retract a roof for a convertible vehicle has proved difficult.

In the embodiment shown in FIG. 5, the convertible top is formed over the main frame of the cabin of the vehicle 40. The top may be a flexible material spread over support struts 41 and 42 forming the majority of the actuated members for the top. These themselves may be supported by a further arm or member 43. This further arm of member 43 may be contained within the recess 44 in which the retracted convertible top may be housed and assist in extending the convertible top although does not need to be covered by the flexible top or roof material. Additionally, the recess 44 in which the convertible top is housed may be enclosed by one or, in this case, two covering portions 45 and 46.

Referring to FIG. 5, each of the movable members 41 to 46 as shown in this embodiment requires controlled rotation about a pivotal mounting to the main body or another of the support members. Referring to the convertible top supports 41 and 42, it can be seen that the interconnection between these being the rotationally joint 47 may be controlled by shape memory alloy actuators 48 and 49 in the form of wires. Again, as with the previous embodiments, the application of heat to these wires will cause either wire to contract as desired and the connection of the wires from a fixed point on member 42 to a fixed point on member 41 ensures that rotation about joint 47 occurs upon contraction of the shape memory alloy element. Independent control over the actuators 48 and 49 allows the movement about the joint 47 to be controlled in either direction as required.

Referring to the pivotally mounted element 46 to enclose the recess 44, it can be seen that the shape memory alloy actuators 51 and 52 act about the rotational joint 50. As shown diagrammatically, each of these actuators may be connected to wires 53 and 54 as shown to supply current to the actuators 51 and 52. In this preferred form, electrical current is used to generate heat in the actuators to control the shape transformation.

The supply of current through wires 53 and 54 may be controlled by a suitable switching mechanism 55 that itself may include a microprocessor. The advantage of such an arrangement is that individual means for communicating electrical current may be attached to each and every shape memory alloy actuator in the figure as shown. In this manner, the microprocessor can control the supply of heat to each wire to provide sequenced movements of each of the joints necessary to control the convertible top. Alternatively, a wire of each pair of actuators may be electrically connected in series or parallel with another of the actuators if two of the joint will always be rotated simultaneously. The designer of the toy vehicle has the choice of either sequenced or simultaneous actuation of each joint.

As with the previous embodiments, again the actuation is by two shape memory alloy actuators for each a rotational joint. This may again be provided as a single shape memory alloy actuator and a biasing means in opposition to the actuator. The biasing means on rotational joints could include a coil spring acting about the joint which is overcome by the force of the actuator in one direction. Once the actuator returns to its low temperature form, the biasing means may dominate and cause the opposed rotation.

Figure 6A:
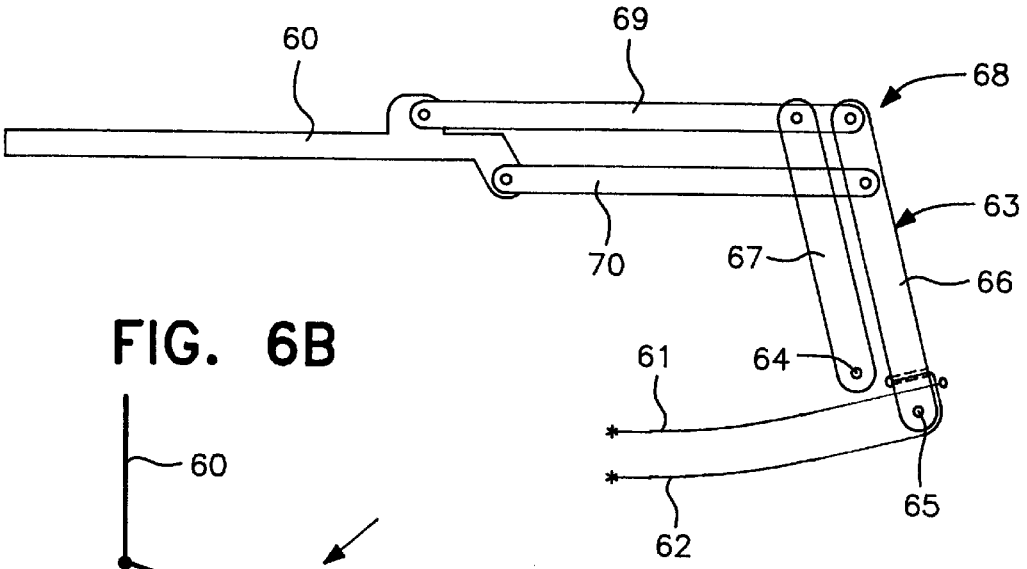
FIG. 6A to C show cross sectional elevations through the activation mechanism for a top of a convertible toy vehicle in accordance with a yet further embodiment of the invention.
Figure 6B:
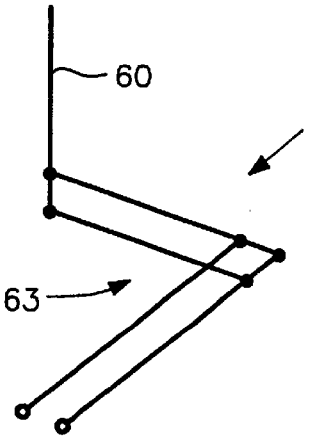
Figure 6C:
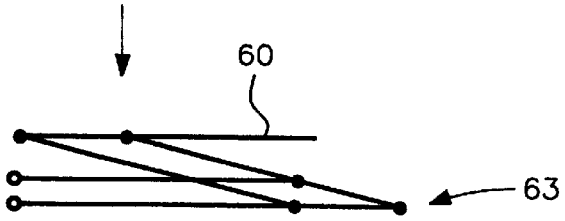

A further embodiment of a convertible top is shown in FIGS. 6A to 6C. In this instance, the convertible top 60 may be actuated by a single movement controlled by shape memory alloy actuators 61 and 62 acting about a rotational mounting 65 of the arrangement to the main body of the vehicle.

In this arrangement, each of the extending members to support the convertible top 60 are provided as a pair of members to form a parallelogram structure 63 as shown. FIGS. 6B and 6C show the sequenced collapsing of the parallelogram of member 63 and convertible top 60. Rotation of only one member 66 about its connection to the main body of the vehicle may force simultaneous rotation of its paired member 67 and through the linkage arrangement 68, cause rotation of the more distal pair of members 69 and 70. This pair of members may be rotationally mounted at different points on the convertible top 60 so as to also cause rotation of that member 60 with respect to the pair of supporting members 69 and 70. Such an arrangement reduced the number of actuators required to extend the convertible top by replacing some of the actuators with mechanical linkages.

Figure 7A:
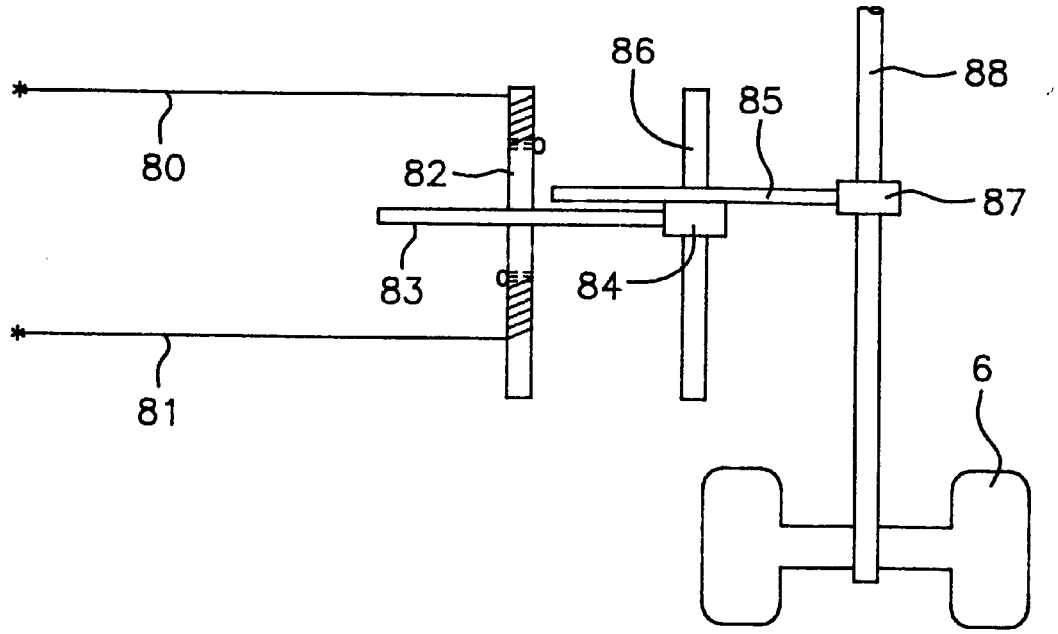
FIGS. 7A and 7B show plane and elevation views of a vehicle drive mechanism in accordance with a yet further embodiment of the invention.
Figure 7B:
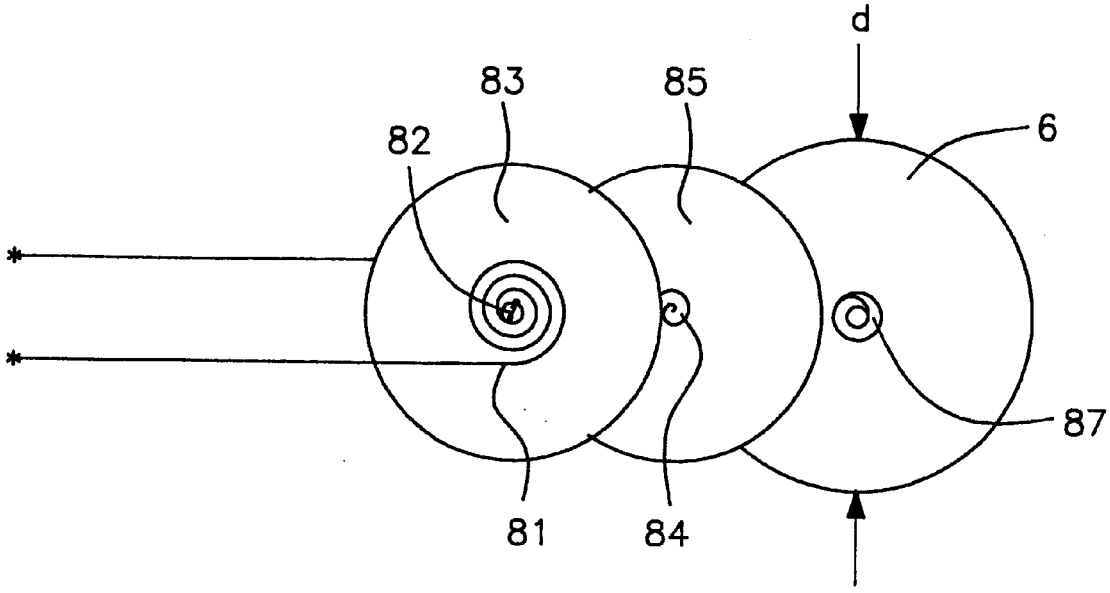

Referring to FIGS. 7A and 7B, a yet further embodiment of the invention is shown. In this instance, shape memory alloy actuators 80 and 81 are used to create drive of a shaft 82. By coiling the actuators 80 and 81 about the shaft 82, a contraction in the length of the actuators 80 or 81 will force rotation of the shaft 82 as the wire uncoils from the shaft 82. In this manner, the actuators are able to create rotation of an element such as shaft 82 of greater than 360 degrees. Such a method of actuation in the embodiment shown in 7A is used to drive a gear 83 which itself acts on a further gear 84 acting about shaft 86. A further gear 85 connected to shaft 86 may act on a yet further gear 87 acting about shaft 88. This sequence of gears and rotational shafts allows the original rotation of shaft 82 to be geared up to drive shaft 88 which is provided as the drive shaft for wheel 6 as shown.

In this manner, the shape memory alloy actuator 80 is along capable of driving the wheel 6 to cause motion of the vehicle as a whole and replace the main drive mechanism of the vehicle.

The arrangement is shown in side elevation in FIG. 7B to further demonstrate the sequencing of the various gears.

As shown in this embodiment, again two actuators 80 and 81 are used in opposition to each other. These will allow forward and reverse drive to be applied although the total distance of travel is restricted to the degree of contraction of these actuators and the gearing involved. Therefore, only limited forward travel is available before the rotation of the wheel 6 must be reversed.

Although this embodiment shows a drive mechanism in which the actuators 80 and 81 provide oscillating forward and reverse rotation of shaft 82 and, thereby, oscillating forward and reverse rotation of the wheel 6, other arrangements are possible. Many other mechanical mechanisms are well known to transfer rotational oscillating motion of a shaft into continuous rotation in a single direction only. The incorporation of such a mechanism could allow alternating activation of the shape memory alloy actuators to cause continuous rotation of the wheel 6 in a single direction if desired. However, such mechanisms may be more expensive.

Thus it can be seen that this invention provides a variety of actuators for use throughout the vehicle. The use of shape memory alloy in the form of a wire, spring or similar allows very small elements to be connected to the item for which motion is desired. These wires can be incorporated within the spaces between body panels of the vehicles and can be controlled by any convenient heat source. The use of electrical current is a preferred example as an electrical wire to the shape memory alloy element is again an easier method of transportation of energy to create heat. This also allows programmable control over the actuators as desired when used in conjunction with a microprocessor or similar to switch current to and from various actuators throughout the vehicle.

Although this invention has been described with reference to a number of preferred embodiments, it will be appreciated that the invention is not restricted to those particular examples but instead defined by the scope of the appended claims. Reference to particular integers is deemed to incorporate known equivalents where appropriate and items referred to in the singular may also include the plural if desired.

What is claimed is:

1. A toy vehicle comprising:

a main body portion;

at least one movable component connected to said main body portion capable of reciprocating motion between a first position and a second position;

a drive mechanism to actuate motion of said at least one movable component to the first or the second position including;

a. a pivot connected to said at least one movable component; and b. a pair of a first and a second wire formed from a shape memory alloy that drives said at least one movable component by contraction of the wire to the corresponding first or second position upon the supply of heat to one of said first and second wire; and means to heat any one of said first and second wire independently of heating the other of said first and second wire.

2. A toy vehicle as claimed in claim 1 wherein said means to independently heat said any one of said first and second wire comprise a source of electrical current and means to communicate current selectively through said any one of said first and second wire.

3. A toy vehicle as claimed in claim 1 wherein said at least one movable component connected to said main body portion comprises a rotational mounted door or hood of said vehicle.

4. A toy vehicle as claimed in claim 1 wherein said at least one component attached to or with said main body portion comprises a steering arm to steer said vehicle.

5. A toy vehicle as claimed in claim 1 wherein said at least one component attached to or with said main body portion comprises a suspension element to raise or lower said main body portion with respect to a wheel.

6. A toy vehicle as claimed in claim 1 wherein said at least one component attached to or with said main body portion comprises a drive shaft for motion of said vehicle.

* * * * *